US010147368B2

(12) United States Patent
Zhang

(10) Patent No.: US 10,147,368 B2
(45) Date of Patent: Dec. 4, 2018

(54) IMAGE PROCESSING METHODS

(71) Applicant: Shenzhen China Star Optoelectronics Technology Co., Ltd., Shenzhen, Guangdong (CN)

(72) Inventor: Yuan Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 195 days.

(21) Appl. No.: 15/308,591

(22) PCT Filed: Sep. 13, 2016

(86) PCT No.: PCT/CN2016/098809
§ 371 (c)(1),
(2) Date: Nov. 2, 2016

(87) PCT Pub. No.: WO2018/035899
PCT Pub. Date: Mar. 1, 2018

(65) Prior Publication Data

US 2018/0190213 A1 Jul. 5, 2018

(30) Foreign Application Priority Data

Aug. 25, 2016 (CN) ..... 2016 1 0724656

(51) Int. Cl.
*G09G 3/36* (2006.01)

(52) U.S. Cl.
CPC ..... *G09G 3/3607* (2013.01); *G09G 3/36* (2013.01); *G09G 2320/029* (2013.01)

(58) Field of Classification Search
CPC combination set(s) only.
See application file for complete search history.

(56) References Cited

U.S. PATENT DOCUMENTS

2016/0379577 A1* 12/2016 Han ..... G09G 3/3607 345/690
2018/0047368 A1* 2/2018 Luo ..... G09G 3/20

* cited by examiner

*Primary Examiner* — Nelson Rosario
*Assistant Examiner* — Scott Au
(74) *Attorney, Agent, or Firm* — Andrew C. Cheng

(57) ABSTRACT

An image processing method includes: (a) calculating an average value of grayscale values of each of pixels in a global raw image; (b) calculating Mura threshold values of the grayscale values of all of the pixels in a local raw image; (c) calculating Mura compensation values for each of the pixels of the local raw image in accordance with the Mura threshold value; (d) obtaining updated grayscale values of each of the pixels in the local raw image by adding the grayscale values of each of the pixels in the local raw image and the corresponding Mura compensation values; (e) displaying the updated image; (f) repeating step (b) to (e) for a plurality of times for the updated image with a changed dimension, and calculating a standard deviation.

20 Claims, 3 Drawing Sheets

IMAGE PROCESSING METHODS

CROSS REFERENCE

This application claims the priority of Chinese Patent Application No. 201610724656.7, entitled "Image processing methods", filed on Aug. 25, 2016, the disclosure of which is incorporated herein by reference in its entirety.

FIELD OF THE INVENTION

The present invention relates to liquid crystal display technology field, and more particularly to an image processing method.

BACKGROUND OF THE INVENTION

Thin film transistor liquid crystal display (TFT-LCD) has been a main product provided by various manufacturers of flat displays. Due to the large-scale and curved-surface trend, the performance of the TFT-LCD has been a key issue deciding whether the manufacturer can be a key player or not. Thus, quality control is a critical issue during the mass production of the TFT-LCDs.

During the mass production of TFT-LCD, one major defect is called the "Mura." The premise is that the grayscale values of all of the RGB pixels have to be the same, however, Mura occurs when the grayscale values of a portion of RGB pixels are quite different from that of the adjacent RGB pixels. In addition, Mura may be shown in a variety of shapes, such as line-shaped, spot-shaped, or other irregular shapes. It is known that various reasons may result in Mura, such as, the assembly or formation of the color filter, the gaps between the units when the glass is installed, too large gap between the pixels, damaged panel substrate, dis-alignment caused by the optical leakage between the top and down substrates. However, due to the above reasons, mostly, the detection time and compensation time for curing the Mura are necessary, not to mention that the compensation effect may not be good enough. Thus, it is needed to apply additional image processing to the images displayed by the LCDs.

SUMMARY OF THE INVENTION

The technical issue that the embodiment of the present invention solves is to provide an image processing method to compensate Mura and to reduce the corresponding detection time and compensation time so as to enhance the display performance.

In one aspect, an image processing method for detecting and compensating Mura of flat displays includes: (a) calculating an average value of grayscale values of each of pixels in a global raw image;

(b) calculating Mura threshold values of the grayscale values of all of the pixels in a local raw image by a median value and the average value of the grayscale values of the pixels in a local raw image via a self-adaption method;

(c) calculating Mura compensation values for each of the pixels of the local raw image in accordance with the Mura threshold value;

(d) obtaining updated grayscale values of each of the pixels in the local raw image by adding the grayscale values of each of the pixels in the local raw image and the corresponding Mura compensation values;

(e) displaying the updated image;

(f) repeating step (b) to (e) for a plurality of times for the updated image with a changed dimension, and calculating a standard deviation in accordance with the grayscale values of each of the pixels of the updated image and the average value of all of the pixels obtained in the step (a);

(g) comparing the standard deviation with a default value; and (h) creating a Mura compensation table in accordance with the standard deviation when the standard deviation is smaller than or equals to the default value, and compressing and storing the Mura compensation table by a wavelet compressed method.

Wherein in step (a), the average value of the grayscale values of each of the pixels in the global raw image is calculated by the equation:

$$V_{lmean} = \frac{1}{n}\sum_{1}^{n} p_i(i, j);$$

wherein $p_i(i,j)$ indicates the grayscale values of each of the pixels, and $V_{lmean}$ indicates the average value of the grayscale values of each of the pixels.

Wherein step (b) further includes:

(b1) dividing the image into a plurality of windows, and calculating the average value and the median value of the grayscale values of the pixels in each of the local raw images within each of the window; and (b2) calculating the Mura threshold values of each of the windows.

Wherein in step (b1), the average value and the median value of the grayscale values of each of the pixels in each of the windows are calculated by the equation:

$$V_{lmean} = \frac{1}{n}\sum_{1}^{n} p_i(i, j)$$

and $V_{median}=\text{med}(p_i(i,j))$, wherein $V_{median}$ indicates the median value of the grayscale values of each of the pixels.

Wherein in step (b2), the Mura threshold value of each of the windows is calculated by the equation:

$$V_t = a*V_{median} + \beta*V_{lmean};$$

wherein $$a = \frac{V_{median}}{V_{lmean} + V_{median}},$$

$\rho=1-a$, and $V_t$ indicates the Mura threshold value.

Wherein in step (c), the Mura compensation value for each of the windows is calculated in accordance with the equation:

$$s(i, j) = \begin{cases} -(p_i(i, j) - V_t), & \text{if } (p_i(i, j) > V_t \\ +(V_t - p_i(i, j), & \text{if } (p_i(i, j) < V_t \\ 0, & \text{if } (p_i(i, j) = V_t \end{cases};$$

wherein s(i,j) indicates the Mura compensation value of the grayscale values of each of the pixels within each of the window.

Wherein in step (f), the standard deviation is calculate by the equation:

$$\sigma = \sqrt{\frac{1}{n}\sum_{1}^{n}(p_{n3}(i, j) - V_{lmean})^2};$$

wherein $p_{n3}(i,j)$ is the grayscale values of each of the pixels.

Wherein in step (g), the process goes to step (b) when the standard deviation is greater than the default value.

Wherein in step (f), the steps (b) to (e) are repeated for two or three times.

Wherein in step (h), the Mura compensation table is compressed and stored by the wavelet method in a non-destructive manner.

In view of the above, the image processing method calculates the Mura values for each of the windows so as to obtain the Mura value of the whole image. The Mura standard deviation is calculated in accordance with the Mura value and the average values of the pixels of the current image, and also the corresponding compensation table is obtained. The Mura of the LCDs may be compensated such that the detection time and the compensation time for reducing the Mura may be decreased. In addition, the compensation table may be compressed and stored by the wavelet algorithm, not only the compensation effect may be enhanced, but also the space for storing the compensation table may be reduced.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

FIG. 2(*b*) is a schematic view showing the three dimensional image of the original image in FIG. 2(*a*).

FIG. 2(*c*) is a schematic view showing the three dimensional image in FIG. 2(*b*) after being compensated.

DETAILED DESCRIPTION OF PREFERRED EMBODIMENTS

Figure 1:
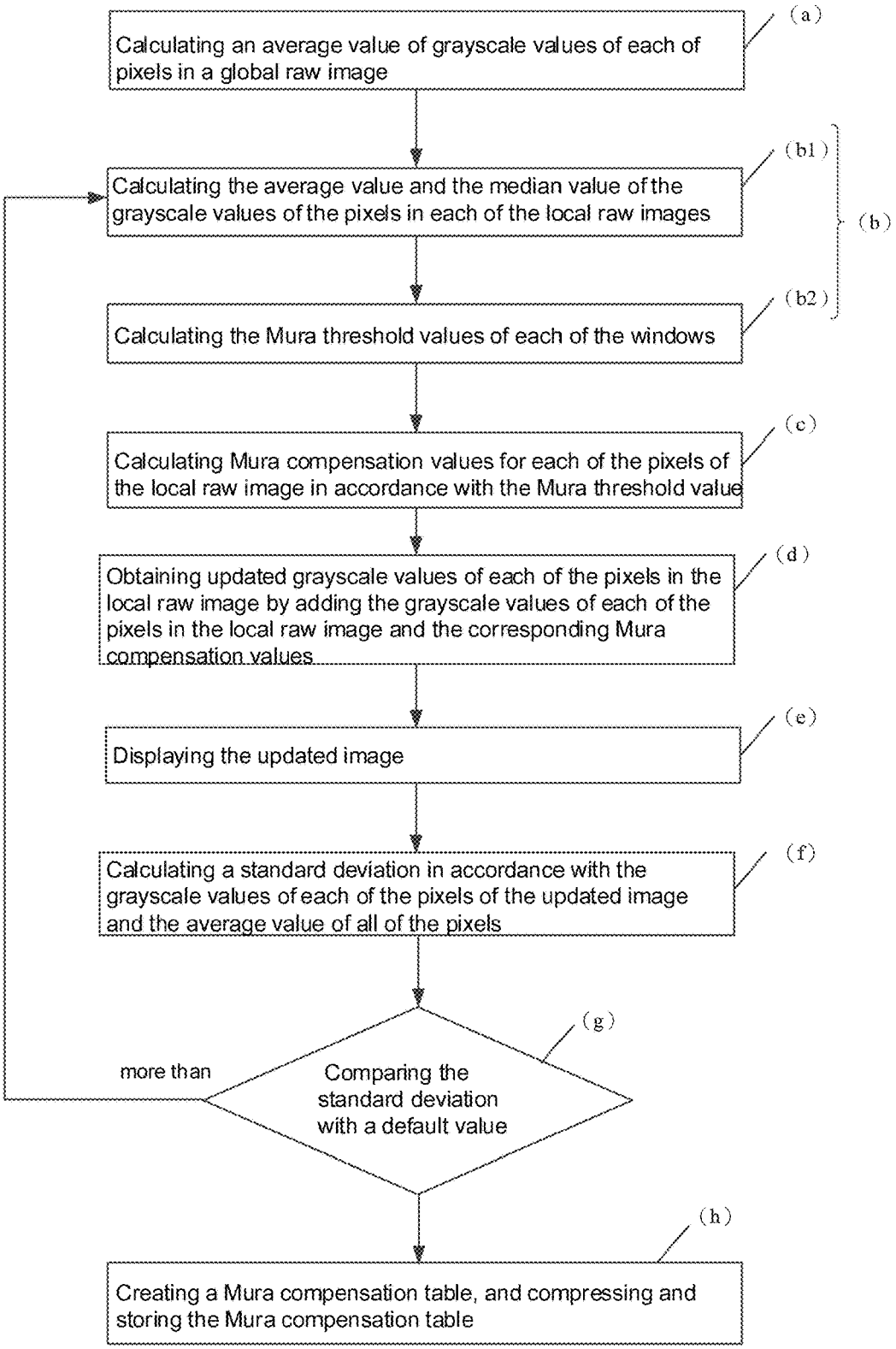
FIG. 1 is a flowchart illustrating the image processing method in accordance with one embodiment.

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

In addition, the following description of the embodiments illustrated with reference to the appended for illustrative embodiment may be used in a specific embodiment of the invention. Direction of the term of the present invention are mentioned, for example, "upper", "lower", "front", "rear", "left", "right", "inside", "outside", "side", etc., only with reference to the attached figures direction, therefore, the direction of terms is only used in order to better and more clearly explain and understand the claimed invention, rather than suggesting that the device or element is limited to the particular orientation, the particular orientation construction and operation, and therefore the claimed invention is not limited thereto.

In the description of the claimed invention, a description that, unless otherwise clearly defined and limited, the term "installation", "connected", "connection" should be broadly understood. For example, the components may be fixed connected, detachably connected or integrally connected. In other examples, the components can be mechanically connected, connected directly, or indirectly connected. Yet in another example, the two components may be internally communicated. Those of ordinary skill in the art may understand the above terms set forth in the specific circumstances in the present disclosure.

Furthermore, in the description of the present disclosure, unless otherwise specified, "a plurality" means two or more. The term "step" not only refers to independent steps, also means the steps capable of achieving the expected effect of the method. Further, in the present disclosure, the symbol "~" means the numerical range expressed by the "~" values described before and after, respectively, as the minimum and maximum values, including the range. In the drawings, similar or identical structural units represented by the same reference numerals.

In one embodiment, the grayscale data of the flat displays collected by a charge coupled device (CCD) is adopted to perform the detection and the compensation with respect to Mura, which can be the Mura recognition in a spot-to-spot manner with 4K or 8K resolution. By adopting statistics methods, such as mean-square deviation, the background data may be obtained via the collected grayscale data. Afterward, a spot-to-spot Mura compensation table of 4K or 8K resolution may be obtained via the background data and the original data. As the Mura compensation table is of 12 bits, a wavelet algorithm is adopted to compress the Mura compensation table to be 1/16 or 1/64 of the original data, and the compressed Mura compensation table is stored within the timing controller (TCON) to reduce the hardware cost of the TCON. When the LCD displays, the wavelet algorithm is adopted to restore the compressed Mura compensation table stored within the timing controller (TCON).

FIG. 1 is a flowchart illustrating the image processing method in accordance with one embodiment. The method may compensate the Mura by processing the images to be displayed by the LCD. As shown in FIG. 1, the method includes the following steps:

(a) calculating an average value of grayscale values of each of pixels in a global raw image;

Specifically, in step (a), the average value of the grayscale values of each of the pixels in the global raw image is calculated by the equation:

$$V_{lmean} = \frac{1}{n}\sum_{1}^{n} p_i(i, j),$$

wherein $p_i(i,j)$ indicates the grayscale values of each of the pixels, and $V_{lmean}$ indicates the average value of the grayscale values of each of the pixels;

(b) calculating Mura threshold values of the grayscale values of all of the pixels in a local raw image by a median value and the average value of the grayscale values of the pixels in a local image via a self-adaption method;

Specifically, the step (b) may include the following sub-steps:

(b1) dividing the raw image into a plurality of windows, and calculating the average value and the median value of the grayscale values of the pixels in each of the local images within each of the window;

Specifically, in step (b1), the average value and the median value of the grayscale values of each of the pixels in each of the windows are calculated by the equation:

$$V_{lmean} = \frac{1}{n}\sum_{1}^{n} p_i(i, j)$$

and $V_{median}$=med($p_i$(i,j)), wherein $V_{median}$ indicates the median value of the grayscale values of each of the pixels;

In step (b2), calculating the Mura threshold values of each of the windows;

Specifically, in step (b2), the Mura threshold value of each of the windows is calculated by the equation: $V_t = a*V_{median} + \beta*V_{lmean}$, wherein $$a = \frac{V_{median}}{V_{lmean} + V_{median}},$$

$\beta = 1 - a$, and $V_t$ indicates the Mura threshold value.

In step (c), calculating Mura compensation values for each of the pixels of the local raw image in accordance with the Mura threshold value;

Specifically, in step (c), the Mura compensation value for each of the pixels of the local raw image is calculated in accordance with the Mura threshold value;

Specifically, in step (c), the Mura compensation value for each of the windows may be calculated in accordance with the equation:

$$s(i, j) = \begin{cases} -(p_i(i, j) - V_t), & \text{if } (p_i(i, j) > V_t \\ +(V_t - p_i(i, j), & \text{if } (p_i(i, j) < V_t \\ 0, & \text{if } (p_i(i, j) = V_t \end{cases};$$

wherein s(i,j) indicates the Mura compensation value of the grayscale values of each of the pixels within each of the window.

In step (d), obtaining updated grayscale values of each of the pixels in the local raw image by adding the grayscale values of each of the pixels in the local raw image and the corresponding Mura compensation value;

Specifically, in step (d), the updated grayscale values of each of the pixels of the local image may be:

$$p_{n1}(i,j) = s(i,j) + p_i(i,j).$$

In step (e), displaying the updated image;

In step (f), repeating step (b) to (e) for N times for the updated image to obtain the grayscale values of each of the pixels of the image being updated by N-th times. When the image being updated by N-th times is inputted, calculating a standard deviation in accordance with the grayscale values of each of the pixels of the image being updated by (N−1)-th times and the average value of all of the pixels obtained in step (a);

Specifically, in an example, the step (b) to (e) may be repeated for N times, wherein N=2 or 3. In step (f), the grayscale value of each of the pixels of the image being updated by N times is $p_{n3}$(i,j), and the standard deviation may be obtained by the equation:

$$\sigma = \sqrt{\frac{1}{n}\sum_{1}^{n}(p_{n3}(i, j) - V_{tmean})^2}.$$

In step (g), comparing the standard deviation with a default value;

Specifically, in step (g), the default value may be determined in accordance with the quality of the displayed image. When the standard deviation is smaller than or equals to the default value, the process goes to step (h); and when the standard deviation is greater than the default value, the process goes to step (b).

In step (h), generating the Mura compensation table in accordance with the standard deviation, compressing the Mura compensation table, and storing the Mura compensation table.

Specifically, in step (h), the Mura compensation table is compressed (for instance, for two or three times) and stored by the wavelet algorithm. The stored Mura compensation table is stored within the timing controller (TCON). It can be understood that the timing controller (TCON) may restore the Mura compensation table in a non-destructive manner, and the LCD may display the images. That is, the wavelet algorithm may be adopted to compress the Mura compensation table and to restore the Mura compensation table in the non-destructive manner.

The following disclosure will explain the image processing method with reference to the above flowchart.

(1) Calculating an average value of grayscale values of each of pixels in a global raw image;

Specifically, the average value of the grayscale values of each of the pixels in the global raw image is calculated by the equation:

$$V_{lmean} = \frac{1}{n}\sum_{1}^{n} p_i(i, j),$$

wherein $p_i$(i,j) indicates the grayscale values of each of the pixels, and $V_{lmean}$ indicates the average value of the grayscale values of each of the pixels;

(2) calculating Mura threshold values of the grayscale values of all of the pixels in a local raw image by a median value and the average value of the grayscale values of the pixels in a local image via a self-adaption method; and calculating a Mura compensation value for each of the pixels of the local raw image in accordance with the Mura threshold value. When the first frame of grayscale images to be collected is inputted, the frame of the image is divided into 16*16 windows. For instance, the frame of the image with the resolution 1920*1080 is divided into 120*68 window, and the calculation below has to be conducted for each of the windows:

(2-1) divided the raw image into a plurality of windows, and calculating the average value and the median value of the grayscale values of each of the pixels in each of the windows by the equation:

$$V_{lmean} = \frac{1}{n}\sum_{1}^{n} p_i(i, j)$$

and $V_{median}$=med($p_i$(i,j)), wherein $V_{median}$ indicates the median value of the grayscale values of each of the pixels;

(2-2) calculating the Mura threshold of each of the windows;

Specifically, the Mura threshold of each of the windows is calculated by the equation: $V_t = a*V_{median} + \beta*V_{lmean}$, wherein $$a = \frac{V_{median}}{V_{lmean} + V_{median}},$$

$\beta$=1−a, and $V_t$ indicates the Mura threshold; and (2-3) calculating a Mura compensation value for each of the pixels of the local raw image in accordance with the Mura threshold value;

Specifically, the Mura compensation value for each of the pixels of the local raw image is calculated in accordance with the Mura threshold value $V_t$ and the equation below:

$$s(i, j) = \begin{cases} -(p_i(i, j) - V_t), & \text{if } (p_i(i, j) > V_t \\ +(V_t - p_i(i, j), & \text{if } (p_i(i, j) < V_t \\ 0, & \text{if } (p_i(i, j) = V_t \end{cases};$$

wherein s(i,j) indicates the Mura compensation value of the grayscale values of each of the pixels within each of the window.

(2-4) Obtaining the grayscale values of each of the pixels in the firstly updated image by adding the grayscale values of each of the pixels in the raw image and the calculated Mura compensation value;

Specifically, the updated grayscale values of each of the pixels of the raw image may be:

$$p_{n1}(i,j)=s(i,j)+p_i(i,j).$$

(2-5) displaying the updated image on the LCD, wherein the grayscale values of each of the pixels of the image have been updated, and preparing to collect the next image.

(3) dividing the image to be 32*32 windows after inputting the updated image in step (2). For instance, the input image having resolution of 1920*1080 is divided into 60*34 windows. The steps (2-1) to (2-5) are repeated for each of the windows, and the grayscale values of each of the pixels of the updated image is: $p_{n2}(i,j)=s(i,j)+p_{n1}(i,j)$. The image with the updated grayscale values for each of the pixels is displayed on the LCD and then the process goes to collect the next image.

(4) when the grayscale image updated in the step (3) is inputted, the image is divided into 64*64 windows. For instance, the frame of the image with the resolution 1920*1080 is divided into 30*17 windows, the steps (2-1) to (2-5) are repeated for each of the windows, and the grayscale values of each of the pixels of the updated image is: $p_{n3}(i,j)=s(i,j)+p_{n2}(i,j)$. The image with the updated grayscale values for each of the pixels is displayed on the LCD and then the process goes to collect the next image. By adopting the windows of different sizes, with respect to the impact toward the Mura recognition caused by the grayscale values, not only the grayscale values of the local pixels are considered, but also the grayscale values of the pixels in large scope are also considered.

(5) when the image with the updated grayscale values $p_{n3}(i,j)$ is inputted in step (4), the standard deviation is calculated in accordance with the grayscale values of the image updated in the step (3) and the $V_{lmean}$ obtained in the step (1). Specifically, the standard deviation may be obtained by the equation:

$$\sigma = \sqrt{\frac{1}{n}\sum_{1}^{n}(p_{n3}(i, j) - V_{lmean})^2};$$

(6) comparing the standard deviation with a default value, wherein the default value may be determined in accordance with the quality of the displayed image. When the standard deviation is smaller than or equals to the default value, the process goes to step (7); and when the standard deviation is greater than the default value, the process goes to step (2).

In step (7), generating the Mura compensation table in accordance with the standard deviation, compressing the Mura compensation table, and storing the Mura compensation table.

Specifically, in step (7), calculating Mura threshold values for each of the windows by a self-adaption method so as to recognize the Mura. In addition, creating a Mura compensation table by the self-adaption method. The Mura compensation table is compressed (for instance, for two or three times) and is stored within the timing controller (TCON). It can be understood that the timing controller (TCON) may restore the Mura compensation table in a non-destructive manner by the wavelet algorithm, and the LCD may display the images. That is, the wavelet algorithm may be adopted to compress the Mura compensation table and to restore the Mura compensation table in the non-destructive manner.

Figure 2A:
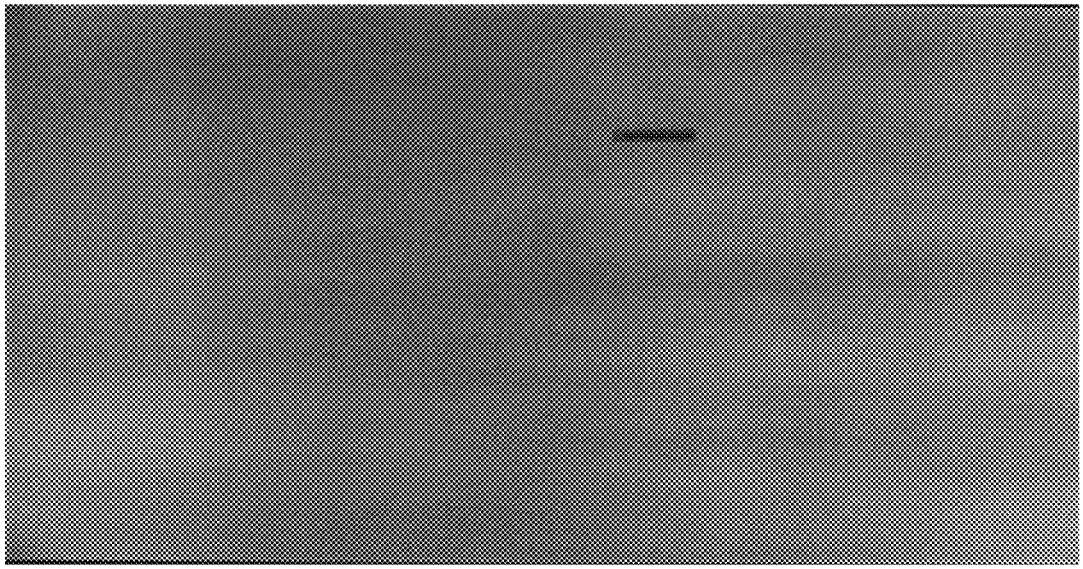
FIG. 2(*a*) is a schematic view showing the two dimensional image of the original image in accordance with one embodiment.
Figure 2B:
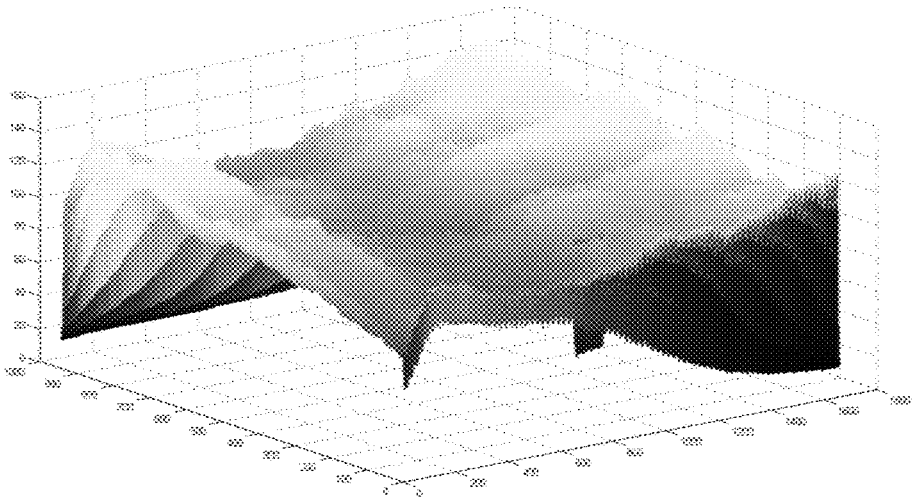
Figure 2C:
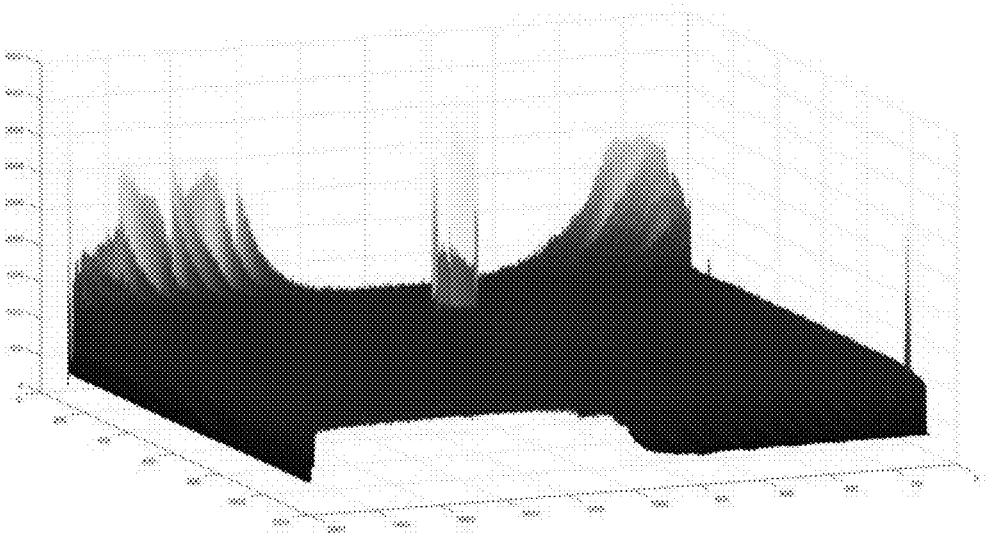

Also referring to FIGS. 2(*a*) to 2(*c*), wherein FIG. 2(*a*) is a schematic view showing the two dimensional image of the original image in accordance with one embodiment. FIG. 2(*b*) is a schematic view showing the three dimensional image of the original image in FIG. 2(*a*). FIG. 2(*c*) is a schematic view showing the three dimensional image in FIG. 2(*b*) after being compensated. In view of FIG. 2(*c*), it can be seen that, after being compensated by the image processing method, the image density of each of the coordinates (x, y) can be clearly displayed on the image. In addition, the edges and the internal of the image are smooth, such that better display performance may be obtained.

In view of the above, the image processing method calculates the Mura values for each of the windows so as to obtain the Mura value of the whole image. The Mura standard deviation is calculated in accordance with the Mura value and the average values of the pixels of the current image, and also the corresponding compensation table is obtained. The Mura of the LCDs may be compensated such that the detection time and the compensation time for reducing the Mura may be decreased. In addition, the compensation table may be compressed and stored by the wavelet algorithm, not only the compensation effect may be enhanced, but also the space for storing the compensation table may be reduced.

In the present disclosure, the term "one embodiment," "some embodiments", "an example", "concrete example" or "some examples" are used to describe particular features, structures, materials, or characteristics included in the claimed invention. In the present disclosure, the terms of the above schematic representation are not necessarily referring to the same embodiment or example. Furthermore, the particular features, structures, materials, or characteristics described may be combined in an appropriate way in any one or more embodiments or examples.

Above are embodiments of the present invention, which does not limit the scope of the present invention. Any modifications, equivalent replacements or improvements within the spirit and principles of the embodiment described above should be covered by the protected scope of the invention.

What is claimed is:

1. An image processing method for detecting and compensating Mura of flat displays, comprising:

(a) calculating an average value of grayscale values of each of pixels in a global raw image;

(b) calculating Mura threshold values of the grayscale values of all of the pixels in a local raw image by a median value and the average value of the grayscale values of the pixels in a local raw image via a self-adaption method;

(c) calculating Mura compensation values for each of the pixels of the local raw image in accordance with the Mura threshold value;

(d) obtaining updated grayscale values of each of the pixels in the local raw image by adding the grayscale values of each of the pixels in the local raw image and the corresponding Mura compensation values;

(e) displaying the updated image;

(f) repeating step (b) to (e) for a plurality of times for the updated image with a changed dimension, and calculating a standard deviation in accordance with the grayscale values of each of the pixels of the updated image and the average value of all of the pixels obtained in the step (a);

(g) comparing the standard deviation with a default value; and (h) creating a Mura compensation table in accordance with the standard deviation when the standard deviation is smaller than or equals to the default value, and compressing and storing the Mura compensation table by a wavelet compressed method.

2. The image processing method as claimed in claim 1, wherein in step (a), the average value of the grayscale values of each of the pixels in the global raw image is calculated by the equation:

$$V_{lmean} = \frac{1}{n}\sum_{1}^{n} p_i(i, j);$$

wherein $p_i(i,j)$ indicates the grayscale values of each of the pixels, and $V_{lmean}$ indicates the average value of the grayscale values of each of the pixels.

3. The image processing method as claimed in claim 2, wherein step (b) further comprises:

(b1) dividing the image into a plurality of windows, and calculating the average value and the median value of the grayscale values of the pixels in each of the local raw images within each of the window; and (b2) calculating the Mura threshold values of each of the windows.

4. The image processing method as claimed in claim 3, wherein in step (b1), the average value and the median value of the grayscale values of each of the pixels in each of the windows are calculated by the equation:

$$V_{lmean} = \frac{1}{n}\sum_{1}^{n} p_i(i, j)$$

and $V_{median}$=med($p_i$)(i,j)), wherein $V_{median}$ indicates the median value of the grayscale values of each of the pixels.

5. The image processing method as claimed in claim 4, wherein in step (b2), the Mura threshold value of each of the windows is calculated by the equation:

$$V_t = a*V_{median} + \beta*V_{lmean};$$

wherein $$a = \frac{V_{median}}{V_{lmean} + V_{median}},$$

$\beta$=1−a, and $V_t$ indicates the Mura threshold value.

6. The image processing method as claimed in claim 5, wherein in step (c), the Mura compensation value for each of the windows is calculated in accordance with the equation:

$$s(i, j) = \begin{cases} -(p_i(i, j) - V_t), & \text{if } (p_i(i, j) > V_t \\ +(V_t - p_i(i, j), & \text{if } (p_i(i, j) < V_t \\ 0, & \text{if } (p_i(i, j) = V_t \end{cases};$$

wherein s(i,j) indicates the Mura compensation value of the grayscale values of each of the pixels within each of the window.

7. The image processing method as claimed in claim 1, wherein in step (f), the standard deviation is calculate by the equation:

$$\sigma = \sqrt{\frac{1}{n}\sum_{1}^{n}(p_{n3}(i, j) - V_{tmean})^2};$$

wherein $p_{n3}(i,j)$ is the grayscale values of each of the pixels.

8. The image processing method as claimed in claim 1, wherein in step (g), the process goes to step (b) when the standard deviation is greater than the default value.

9. The image processing method as claimed in claim 1, wherein in step (f), the steps (b) to (e) are repeated for two or three times.

10. The image processing method as claimed in claim 1, wherein in step (h), the Mura compensation table is compressed and stored by the wavelet method in a non-destructive manner.

11. The image processing method as claimed in claim 2, wherein in step (f), the standard deviation is obtained by the equation:

$$\sigma = \sqrt{\frac{1}{n}\sum_{1}^{n}(p_{n3}(i, j) - V_{tmean})^2};$$

wherein $p_{n3}(i,j)$ is the grayscale values of each of the pixels.

12. The image processing method as claimed in claim 3, wherein in step (f), the standard deviation is obtained by the equation:

$$\sigma = \sqrt{\frac{1}{n}\sum_{1}^{n}(p_{n3}(i,\ j) - V_{tmean})^2};$$

wherein $p_{n3}(i,j)$ is the grayscale values of each of the pixels.

13. The image processing method as claimed in claim 4, wherein in step (f), the standard deviation is obtained by the equation:

$$\sigma = \sqrt{\frac{1}{n}\sum_{1}^{n}(p_{n3}(i,\ j) - V_{tmean})^2};$$

wherein $p_{n3}(i,j)$ is the grayscale values of each of the pixels.

14. The image processing method as claimed in claim 5, wherein in step (f), the standard deviation is obtained by the equation:

$$\sigma = \sqrt{\frac{1}{n}\sum_{1}^{n}(p_{n3}(i,\ j) - V_{tmean})^2};$$

wherein $p_{n3}(i,j)$ is the grayscale values of each of the pixels.

15. The image processing method as claimed in claim 6, wherein in step (f), the standard deviation is obtained by the equation:

$$\sigma = \sqrt{\frac{1}{n}\sum_{1}^{n}(p_{n3}(i,\ j) - V_{tmean})^2};$$

wherein $p_{n3}(i,j)$ is the grayscale values of each of the pixels.

16. The image processing method as claimed in claim 2, wherein in step (h), the compressed Mura compensation table is stored within a timing controller (TCON) by the wavelet method, and the timing controller (TCON) restores the Mura compensation table via the wavelet method in a non-destructive manner.

17. The image processing method as claimed in claim 3, wherein in step (h), the compressed Mura compensation table is stored within a timing controller (TCON) by the wavelet method, and the timing controller (TCON) restores the Mura compensation table via the wavelet method in a non-destructive manner.

18. The image processing method as claimed in claim 4, wherein in step (h), the compressed Mura compensation table is stored within a timing controller (TCON) by the wavelet method, and the timing controller (TCON) restores the Mura compensation table via the wavelet method in a non-destructive manner.

19. The image processing method as claimed in claim 5, wherein in step (h), the compressed Mura compensation table is stored within a timing controller (TCON) by the wavelet method, and the timing controller (TCON) restores the Mura compensation table via the wavelet method in a non-destructive manner.

20. The image processing method as claimed in claim 6, wherein in step (h), the compressed Mura compensation table is stored within a timing controller (TCON) by the wavelet method, and the timing controller (TCON) restores the Mura compensation table via the wavelet method in a non-destructive manner.

* * * * *